US006877503B1

(12) United States Patent
Hibshman, II et al.

(10) Patent No.: US 6,877,503 B1
(45) Date of Patent: Apr. 12, 2005

(54) HYBRID COOKING RANGE BURNER WITH REMOVABLE GAS AND RADIANT HEAT SUBASSEMBLIES

(75) Inventors: Joell Randolph Hibshman, II, Delanson, NY (US); Azfar Kamal, Louisville, KY (US); Randall Scott Salisbury, Queensbury, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/682,148

(22) Filed: Oct. 8, 2003

(51) Int. Cl.[7] ..... F24C 3/00

(52) U.S. Cl. ..... 126/39 BA; 126/39 R; 392/307; 392/308

(58) Field of Search ..... 126/39 R, 39 BA, 126/39 E, 39 N, 19 R, 214 R; 392/306–310; 219/452.11, 452.12, 458, 467.1, 491, 493

(56) References Cited

U.S. PATENT DOCUMENTS

| | | | | | |
|---|---|---|---|---|---|
| 1,475,608 | A | * | 11/1923 | Templeton | 392/309 |
| 1,716,329 | A | * | 6/1929 | Simpson | 392/309 |
| 2,304,302 | A | * | 12/1942 | Crupi | 392/309 |
| 4,899,723 | A | * | 2/1990 | Pajares | 126/39 R |
| 5,275,147 | A | * | 1/1994 | Aktinson, III | 126/39 BA |
| 5,329,918 | A | * | 7/1994 | Di Bari | 126/39 BA |

FOREIGN PATENT DOCUMENTS

| | | | | |
|---|---|---|---|---|
| JP | 55-65834 | * | 5/1980 | 126/39 BA |
| JP | 55-92823 | * | 7/1980 | 126/39 BA |
| JP | 55-92825 | * | 7/1980 | 126/39 BA |
| JP | 1-269824 | * | 10/1989 | 126/39 BA |
| WO | WO 01/73350 | * | 10/2001 | 126/39 BA |

* cited by examiner

*Primary Examiner*—James C. Yeung
(74) *Attorney, Agent, or Firm*—Fletcher Yoder

(57) ABSTRACT

Burner assembly for a cooking range is provided. The burner assembly includes a gas-heat subassembly, and a radiant heat subassembly. An electromechanical interface is configured to detachably interconnect the subassemblies to one another. The electromechanical interface is further configured to pass electrical power to the radiant heat subassembly.

21 Claims, 3 Drawing Sheets

HYBRID COOKING RANGE BURNER WITH REMOVABLE GAS AND RADIANT HEAT SUBASSEMBLIES

BACKGROUND OF THE INVENTION

The invention is generally related to heating devices for cooking ranges, and, more particularly, to a hybrid cooking range operable with both gas and electric energy sources.

It is known that certain design features (e.g., venturi design and burner port flow passage geometry) that tend to promote high power output in gas burners for cooking ranges also tend to oppose favorable low power output. As a result, operational issues may be experienced at low burn rate settings in conventional gas cooking ranges.

For example, maintenance of relatively low BTU rates may be desirable for simmering. That is, a cooking operation in which a liquefied substance is maintained in a state just below the boiling point of that substance. Examples may include the melting of chocolate or butter, in which the temperature of the liquid should be held below temperatures that could otherwise result in the undesirable burning or boiling of the liquid.

Heating devices that use gas and electric heating elements to heat the contents of a cooking vessel in cooking ranges have been proposed. It is believed that user accessibility to the heating elements and the interior of the range has been difficult. Moreover, it would be desirable to provide a hybrid cooking range that enables consumers to enjoy the aesthetically pleasing aspects (as well as cooking capabilities) of the so-called glass top electric ranges together with the benefits afforded by a gas cooking range.

BRIEF DESCRIPTION OF THE INVENTION

Generally, the present invention fulfills the foregoing needs-by providing in one aspect thereof, a cooking range including a support structure. A burner assembly is provided on the support structure. The burner assembly includes a gas-heat subassembly, and a radiant heat subassembly. An electromechanical interface is configured to detachably interconnect the subassemblies to one another and relative to the support structure. The electromechanical interface is further configured to pass electrical power to the radiant heat subassembly.

In another aspect thereof, the present invention further fulfills the foregoing needs by providing a burner assembly for a cooking range. The burner assembly includes a gas-heat subassembly, and a radiant heat subassembly. An electromechanical interface is configured to detachably interconnect the subassemblies to one another. The electromechanical interface is further configured to pass electrical power to the radiant heat subassembly.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
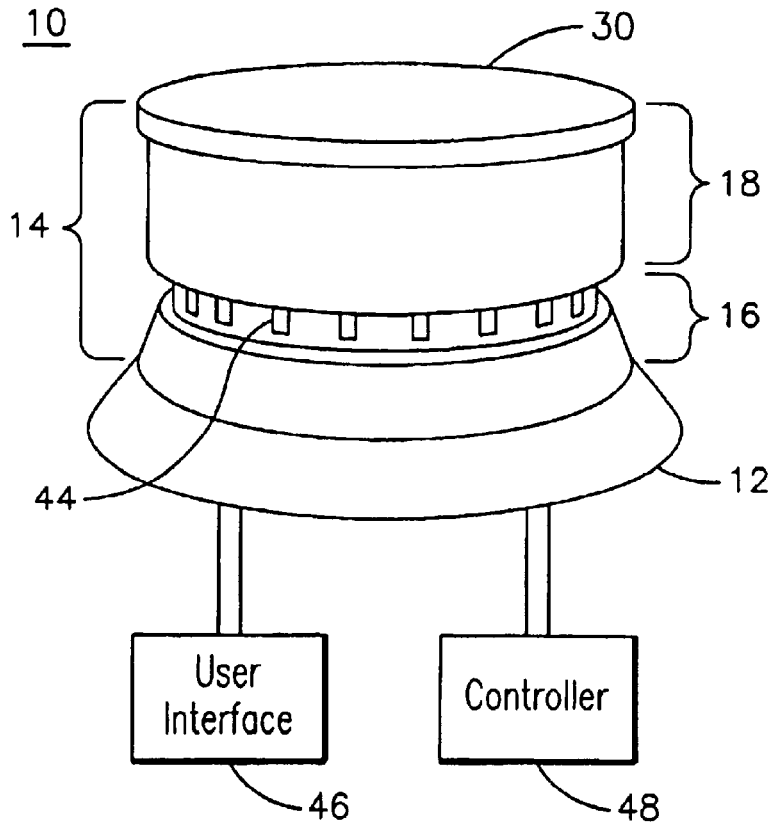
FIG. 1 illustrates an elevational view of part of a cooking range including a burner assembly, such as may be made up of a gas-heat subassembly and a radiant heat subassembly.
Figure 2:
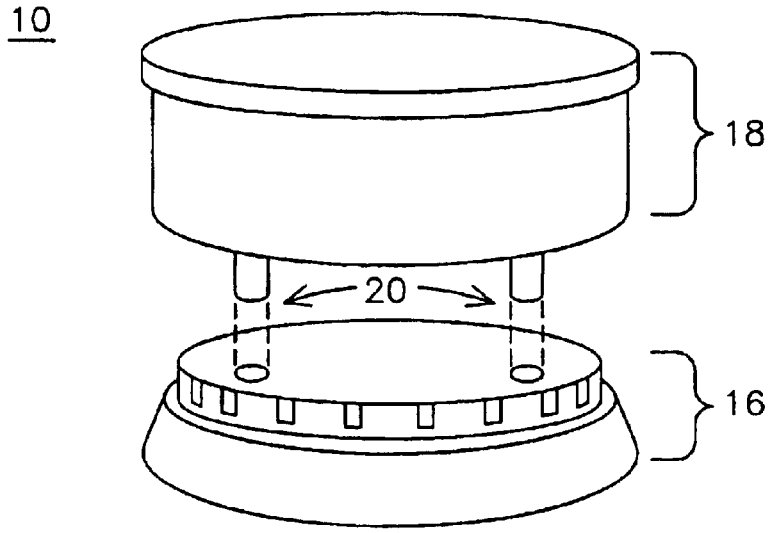
FIG. 2 shows the gas-heat subassembly and the radiant heat subassembly of FIG. 1, as may be detached from one another by way of an electromechanical interface.

FIG. 1 illustrates an elevational view of part of a cooking range 10 including a support structure 12 for supporting a burner assembly 14, such as may be made up of a gas-heat subassembly 16 and a radiant heat subassembly 18. As illustrated in FIG. 2, an electromechanical interface 20 is configured to detachably interconnect subassemblies 16 and 18 to one another and relative to the support structure 12 (FIG. 1). Electromechanical interface 20 is further configured to pass electrical power to the radiant heat subassembly.

Figure 3:
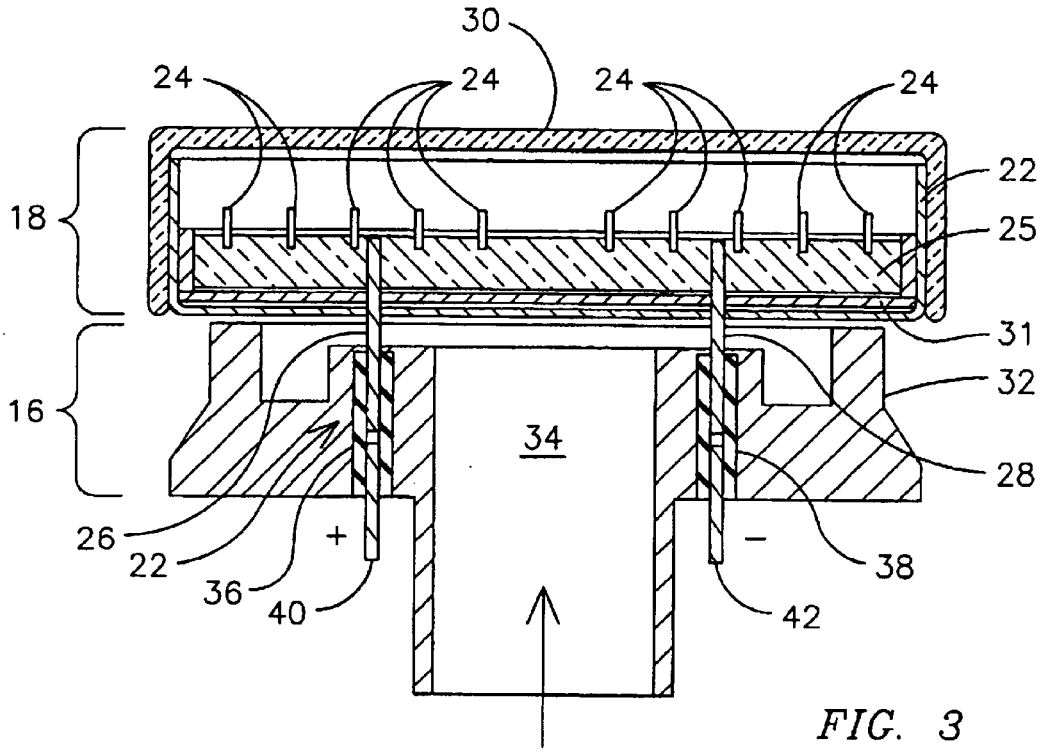
FIG. 3 shows a cross-sectional of the burner assembly of FIG. 1.

As shown in FIG. 3, radiant heat subassembly 18 may comprise a housing 22 for accommodating a radiant heat source 24 disposed in a substrate 25, e.g., a castable ceramic, and two electric terminals 26 and 28 for electrically energizing the radiant heat source 24. Radiant heat subassembly further comprises a radiant heat transmissive cover 30 detachably mounted on the housing 22. A sheet of thermoelectrically insulating material 31, e.g., mica, may be optionally interposed between housing 22 and substrate 25.

The gas-heat subassembly 16 may comprise a gas burner head 32 including a chamber 34 for mixing fuel gas and air. In one exemplary embodiment, electromechanical interface 20 may comprise at least two electrically-insulating bushings 36 and 38 embedded in the gas-heat subassembly for receiving the two electrical terminals 26 and 28 for electrically energizing the radiant heat source. In one exemplary embodiment, electrical terminals 26 and 28 provide a convenient slip-fit interface between the gas-heat subassembly 16 and the radiant heat subassembly 18. Each bushing 36 and 38 may receive at its interior an electrically conductive element for establishing respective electrical connections between terminals 26 and 28 and a corresponding pair of electrical terminals 40 and 42, as may be connectable through suitable wiring and associated components to an external power outlet (not shown).

Figure 4:
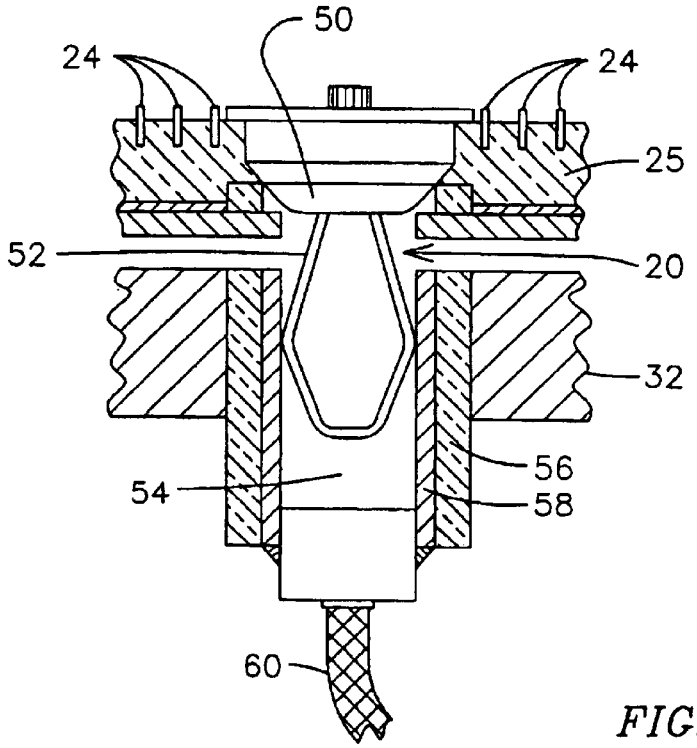
FIG. 4 shows a cross-sectional view of another exemplary embodiment of the electromechanical interface for connecting the gas-heat subassembly and the radiant heat subassembly and for energizing a radiant heat source.

FIG. 4 shows a cross-sectional view of another exemplary embodiment of electromechanical interface 20. In this exemplary embodiment, electromechanical interface 20 comprises a plug 50 (e.g., a so called banana plug) including a flexible spring-metal tip 52 that allows providing a slip fit in a bore 54 defined by a ceramic tube 56 having an inner electrically conductive tube 58 that enables an electrical connection between the inner tube 58 and radiant heat source 24. That is, the structure defined by inner tube 58 functions as a banana jack for mating with plug 50. Inner tube 58 is electrically connected to an external power source (not shown) through a power cord 60. Plug 50 further allows providing a quick mechanical connect/disconnect interface between gas burner head 32 and the radiant heat subassembly.

It will be appreciated that aspects of the present invention allow broadening the operating range of gas-based cooking ranges. Operating range may be defined as the range between minimum heat output (also known as "simmer power") and maximum heat output. The terms "heat" and "power" may be used interchangeably throughout this description.

Other aspects of the present invention are directed to a hybrid cooking range that allows users to enjoy the advantages of both gas cooking and top glass electric cooking. Chemical energy in the form of gaseous fuel is released in flames stabilized on a plurality of burner ports 44 (FIG. 1). Electrical energy is released as radiant heat from radiant heat source 24 that may be situated above the gas burner head.

In operation, a user would command a desired power level through a suitable user interface 46 (FIG. 1) and a controller 48, e.g., electrical or electromechanical controller, may be configured to select an appropriate level of electrical heating and/or gaseous combustion to generate a desired heat output. It is contemplated that in one exemplary embodiment the radiant heat source alone may provide the lower heating power. That is, the lower end of the power range of the burner may be satisfied just with the radiant heat source. The gaseous fuel burner may be used alone or together with the radiant heat source 24 to provide a total heat output beyond the power ratings of the radiant heat source 24.

In operation, heat is primarily conveyed from the radiant heat source 24 to a cooking vessel by radiation. In one exemplary embodiment, the radiant heat source 24 is covered with a high-temperature glass cover that has relatively high optical transmission in the infrared region and in addition exhibits relatively high heat resistance. The glass cover may be shaped as an inverted dish to shield the electrical element and burner head from spills that may occur during operation of the cooking range.

In one exemplary embodiment, electrical leads from radiant heat source 24 may be routed through the burner head. By way of example, electromechanical interface 20 may comprise male electrical terminals coupled to radiant heat source 24 to snap into female terminals disposed in the burner head for supplying electrical power to radiant heat source 24. An additional functionality that may be provided by electromechanical interface 20 is enabling a mechanical interface between the electric element and the burner head that would allow a user to readily disconnect/connect these components. In one exemplary embodiment, radiant heat source 24 may comprise a ribbon heater stabilized in a material or composition with low thermal conductivity and high dielectric strength to avoid electrical arcing.

In one exemplary embodiment, the glass cover may be mounted by way of a slip fit onto housing 22 and consequently cover 30 is easily removed and can be cleaned in a mechanical dishwasher or manually. This removability characteristic also applies to the entire gas-heat and radiant heat subassemblies with respect to one another and with respect to support structure 12.

Figure 5:
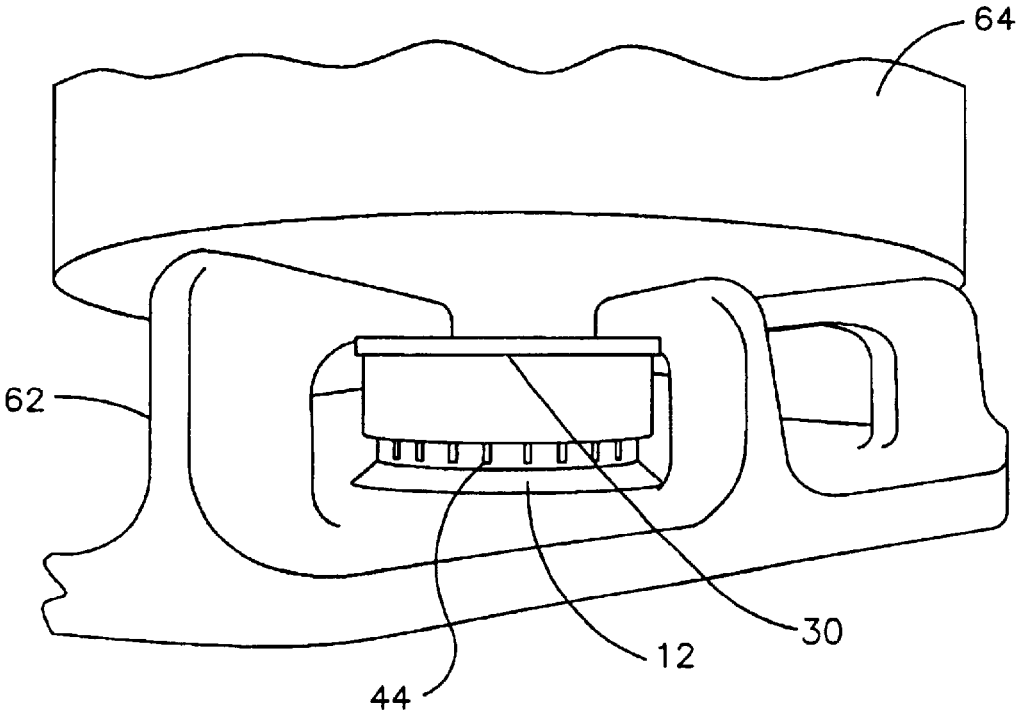
FIG. 5 shows a schematic representation of the burner assembly of FIG. 1 plus a grate structure for supporting a cooking vessel.

A grate structure 62 (FIG. 5) may be optionally situated just above glass cover 30 to avoid direct mechanical contact between a cooking vessel 64 and the glass cover 30. That is, grate structure 62 would support the cooking vessel and thereby avoid the possibility of mechanically shocking the glass cover.

Table 1 below illustrates performance data obtained with a prototype of a hybrid/gas range embodying aspects of the present invention. The data illustrates that the radiant heat subassembly can appropriately maintain an exemplary simmer temperature (e.g., simmer temperature for spaghetti sauce) under various conditions, such as different power levels and/or pot separation relative to the radiant heat.

TABLE 1

Hybrid Gas/Electric Performance

| Electric Power, Watts | Pot Standoff, in | Sauce Avg Temp, ° F. | Sauce Temp Stdev, ° F. | *Zst |
|---|---|---|---|---|
| 420 | 0.2 | 149 | 2.3 | 3.9 |
| | 0.6 | 142 | 1.6 | 1.4 |
| | 1.1 | 138 | 1.9 | −1.1 |
| 280 | 0.2 | 136 | 1.7 | −2.4 |

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A cooking range comprising:

a support structure;

a burner assembly on said support structure, said burner assembly including a gas-heat subassembly and a radiant heat subassembly, said radiant heat subassembly including two electrical terminals for electrically energizing a radiant heat source; and an electromechanical interface configured to detachably interconnect said subassemblies to one another and relative to said support structure, said electromechanical interface further configured to pass electrical power to the radiant heat subassembly, wherein said electromechanical interface comprises at least two electrically-insulating bushings embedded in the gas-heat subassembly for receiving the two electrical terminals.

2. The cooking range of claim 1 wherein said radiant heat subassembly comprises a housing for accommodating the radiant heat source disposed in a substrate.

3. The cooking range of claim 2 wherein said radiant heat subassembly further comprises a radiant heat transmissive cover detachably mounted on said housing.

4. The cooking range of claim 1 wherein said gas-heat subassembly comprises a gas burner head including a chamber for mixing fuel gas and air.

5. The cooking range of claim 1 wherein each of said two electrical terminals provides a respective pluggable interface between the gas-heat subassembly and the radiant heat subassembly.

6. A burner assembly for a cooking range, the burner assembly comprising;

a gas-heat subassembly;

a radiant heat subassembly including two electrical terminals for electrically energizing a radiant heat source therein; and an electromechanical interface configured to detachably interconnect said subassemblies to one another, said electromechanical interface further configured to pass electrical power to the radiant heat subassembly, wherein said electromechanical interface comprises at least two electrically-insulating bushings embedded in the gas-heat subassembly for receiving the two electrical terminals.

7. The burner assembly of claim 6 wherein said radiant heat subassembly comprises a housing for accommodating the radiant heat source disposed in a ceramic substrate.

8. The burner assembly of claim 7 said radiant heat subassembly further comprises a radiant heat transmissive cover detachably mounted on said housing.

9. The burner assembly of claim 6 wherein said gas-heat subassembly comprises a gas burner head including a chamber for mixing fuel gas and air.

10. The burner assembly of claim 6 wherein each of said two electrical terminals provides a respective slip-fit interface between the gas-heat subassembly and the radiant heat subassembly.

11. A method for interfacing a burner assembly in a cooking range, the method comprising:

providing a gas-heat subassembly;

providing a radiant heat subassembly;

detachably interconnecting said subassemblies to one another through an electromechanical interface; and passing electrical power through said electromechanical interface to the radiant heat subassembly, wherein said detachably interconnecting comprises providing a respective slip-fit interface between the gas-heat subassembly and the radiant heat subassembly.

12. A cooking range comprising:

a support structure;

a burner assembly on said support structure, said burner assembly including a gas-heat subassembly and a radiant heat subassembly, said radiant heat subassembly including two electric terminals for electrically energizing a radiant heat source; and an electromechanical interface configured to detachably interconnect said subassemblies to one another and relative to said support structure, said electromechanical interface further configured to pass electrical power to the radiant heat subassembly, wherein said two electric terminals provide a pluggable interface between said gas-heat subassembly and said radiant heat subassembly.

13. The cooking range of claim 12, wherein said electromechanical interface comprises a plug.

14. The cooking range of claim 13, wherein said plug comprises a flexible-spring-metal tip that is configured to provide a slip fit in a bore.

15. The cooking range of claim 13, wherein said plug comprises an electrically conductive tube that is configured to provide an electrical connection between said electrically conductive tube and said radiant heat source.

16. A burner assembly for a cooking range, the burner assembly comprising:

a gas-heat subassembly;

a radiant heat subassembly, said radiant heat subassembly including two electric terminals for electrically energizing a radiant heat source; and an electromechanical interface configured to detachably interconnect said subassemblies to one another, said electromechanical interface further configured to pass electrical power to the radiant heat subassembly, wherein said two electric terminals provide a slip-fit interface between said gas-heat subassembly and said radiant heat subassembly.

17. The cooking range of claim 16, wherein said electromechanical interface comprises a plug.

18. The cooking range of claim 17, wherein said plug comprises a flexible spring-metal tip that is configured to provide a slip fit in a bore.

19. The cooking range of claim 17, wherein said plug comprises an electrically conductive tube that is configured to provide an electrical connection between said electrically conductive tube and said radiant heat source.

20. A method for interfacing a burner assembly in a cooking range, the method comprising:

providing a gas-heat subassembly;

providing a radiant heat subassembly, said radiant assembly including two electric terminals for electrically energizing a radiant heat source;

detachably interconnecting said subassemblies to one another through an electromechanical interface; and passing electrical power through said electromechanical interface to said radiant heat subassembly, wherein each of said two electric terminals provides a respective pluggable interface between said gas-heat subassembly and said radiant heat subassembly.

21. A burner assembly for a cooking range, the burner assembly comprising:

a gas-heat subassembly including a plug;

a radiant subassembly including two electric terminals for electrically energizing a radiant heat source; and an electromechanical interface configured to pluggably interconnect said plug to said electric terminals, said electromechanical interface further configured to pass electrical power to said radiant heat subassembly.

* * * * *